US008529040B2

(12) United States Patent
Yamamoto et al.

(10) Patent No.: US 8,529,040 B2
(45) Date of Patent: Sep. 10, 2013

(54) PRINTHEAD AND PRINTING APPARATUS

(75) Inventors: Shinji Yamamoto, Kawasaki (JP); Junya Kawase, Yokohama (JP); Manabu Sueoka, Yokohama (JP); Yohji Ara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 634 days.

(21) Appl. No.: 12/679,769

(22) PCT Filed: Nov. 7, 2008

(86) PCT No.: PCT/JP2008/070723

§ 371 (c)(1),
(2), (4) Date: Mar. 24, 2010

(87) PCT Pub. No.: WO2009/066612

PCT Pub. Date: May 28, 2009

(65) Prior Publication Data

US 2010/0289856 A1 Nov. 18, 2010

(30) Foreign Application Priority Data

Nov. 22, 2007 (JP) ..... 2007-302977

(51) Int. Cl.
*B41J 2/175* (2006.01)

(52) U.S. Cl.
USPC ..... 347/92; 347/84; 347/85

(58) Field of Classification Search
USPC ..... 347/84, 85, 8, 92
See application file for complete search history.

(56) References Cited

U.S. PATENT DOCUMENTS

| | | | | |
|---|---|---|---|---|
| 5,347,713 | A | 9/1994 | Shibata et al. | |
| 5,956,062 | A | 9/1999 | Omata et al. | |
| 6,945,643 | B2 * | 9/2005 | Tajima et al. | 347/87 |
| 2004/0008239 | A1 * | 1/2004 | Kubota et al. | 347/65 |
| 2008/0024530 | A1 * | 1/2008 | Schalk et al. | 347/8 |
| 2009/0219334 | A1 | 9/2009 | Yamamoto | |
| 2010/0201759 | A1 | 8/2010 | Kawase et al. | |

FOREIGN PATENT DOCUMENTS

| | | | |
|---|---|---|---|
| JP | 8-244250 | A | 9/1996 |
| JP | 11-320901 | A | 11/1999 |
| JP | 2000-301737 | A | 10/2000 |
| JP | 2004-322509 | A | 11/2004 |
| JP | 2006-095868 | A | 4/2006 |
| JP | 2007-144732 | A | 6/2007 |
| JP | 2007-290207 | A | 11/2007 |

* cited by examiner

*Primary Examiner* — Jannelle M Lebron
(74) *Attorney, Agent, or Firm* — Fitzpatrick, Cella, Harper & Scinto

(57) ABSTRACT

A printhead comprises a first ink chamber having an inlet port, to which ink from an ink supply source is supplied, a second ink chamber, to which the ink from the first ink chamber is supplied, a discharge orifice discharging ink from the second ink chamber, a first outlet port discharging fluid from the first ink chamber, a second outlet port discharging fluid from the second ink chamber, and an air-liquid separation unit which restricts liquid ejection and is provided between the first ink chamber and the first outlet port, or/and between the second ink chamber and the second outlet port. Flow resistance from the inlet port to the first outlet port is smaller than flow resistance from the inlet port to the second outlet port.

10 Claims, 16 Drawing Sheets

PRINTHEAD AND PRINTING APPARATUS

BACKGROUND OF THE INVENTION

1. Technical Field

The present invention relates to a printhead and a printing apparatus including a printhead, and more particularly, to an inkjet printing apparatus in which ink is supplied from a main tank holding a large amount of ink to a printhead through a sub-tank.

2. Background Art

Recently, inkjet printing apparatuses are widely used as printers of personal computers or copying machines. Since the inkjet printing apparatus is inexpensive and capable of full-color printing, the apparatus' demand is increasing. Also, the technique of inkjet printing is applied in photographic image printing, in which multi-tone image printing is necessary.

Such a multi-tone image printer can express a much larger number of tones than the actually mounted number of ink types by using in combination plural types of ink having different densities and superimposing the plural types of ink a couple of times. Recently, inkjet printers are also used in plotters which print photographic images on a large-size sheet, such as A1 (594 mm×841 mm) and A0 (841 mm×1189 mm).

However, the above-described plotter and photographic image printer consume a large amount of ink. If an ink tank is mounted on the carriage together with a printhead, the ink tank must be exchanged frequently, and it is inconvenient.

Such an inkjet printer consuming a large amount of ink generally uses an ink supply system shown in FIG. 15. FIG. 15 is a schematic diagram of an ink supply system in a conventional inkjet printing apparatus.

As shown in FIG. 15, a printhead H301 is mounted on a carriage H302 which is movable with respect to the apparatus main body. A main tank M303 is fixed to the apparatus main body. The main tank M303 is arranged to be exchangeable when the remaining ink in the main tank M303 is running low.

The printhead H301 is connected with the main tank M303 by an ink flow passage M304, which is consisted of tubes and joints or the like. The carriage H302 moves reciprocally when printing is executed. The motion of the carriage H302 is not disturbed because a flexible tube (e.g., silicon tube or polyethylene tube) is used in at least part of the ink flow passage M304.

The main tank M303 has an air communication hole M305. The inner part of the main tank M303 is in communication with the atmosphere. When the printhead H301 discharges ink, ink is refilled from the main tank M303 to the printhead H301 through the ink flow passage M304.

Inside the printhead H301, there is a sub-tank H310 which directly receives ink from the ink flow passage M304. Below the sub-tank H310 is an individual liquid chamber H309 provided through a filter H307. The individual liquid chamber H309 serves as an ink reserving area for introducing the ink to a printing element substrate H308.

The pressure inside the printhead H301 must be maintained in a negative pressure state so that the ink does not leak from the discharge orifice H306. The pressure inside the printhead H301 is determined by the ink level of the main tank M303. It is preferable that the ink level of the main tank M303 be set at the position lower by 20 mm to 100 mm than the position of the discharge orifice H306 of the printhead H301.

This method can realize ink supply with an extremely simple configuration. However, since the flexible tube used in the ink flow passage M304 is made of rubber or resin, the tube has slight gas permeability.

Because the inner portion of the tube has negative pressure similarly to the inner portion of the printhead H301, air from the atmosphere infiltrates the inner portion of the tube little by little through the tube wall, and bubbles are generated. If the bubbles flow into the sub-tank H310 in the printhead H301, maintaining the negative pressure inside the printhead becomes difficult. Furthermore, ink supply to the individual liquid chamber H309 becomes insufficient and regular ink droplets cannot be discharged. This causes printing defects.

Even if it were possible to prevent air from infiltrating the inner portion of the tube little by little through the tube wall, there is a possibility that air dissolved in the ink may grow into bubbles inside the tube or sub-tank H310. Moreover, there is a possibility that bubbles get inside the sub-tank H310 from the atmosphere.

In view of the above situation, an ink supply system shown in FIG. 16 is proposed as a method for preventing bubbles from getting in the printhead H301 even if bubbles are produced, and furthermore for removing bubbles in the sub-tank by circulating the bubbles.

FIG. 16 is a schematic diagram of another ink supply system in a conventional inkjet printing apparatus. FIG. 16 shows a printhead H301, and a sub-tank H310 which is provided inside the printhead H301 for reserving ink to be supplied to a printing element substrate H308.

The printhead H301 and the sub-tank 310 are mounted on a carriage H302 which is movable with respect to the apparatus main body. A main tank M303 is fixed to the apparatus main body. The main tank M303 is exchangeable when the remaining ink in the main tank M303 is running low. The printhead H301 is connected with the main tank M303 by two ink flow passages: first and second ink flow passages M3041 and M3042, each consisted of tubes and joints.

The first ink flow passage M3041 transfers the ink contained in the main tank M303 to the sub-tank H310. The second ink flow passage M3042 transfers back the ink in the sub-tank H310 to the main tank M303. Provided in midstream of the second ink flow passage M3042 is a pump M311 that generates ink flow by a piston or by rotating plural rollers. The ink in the sub-tank H310 is sent to the main tank M303 by the pump M311.

The main tank M303 has an air communication hole M305. The inner part of the main tank M303 is in communication with the atmosphere. However, since the sub-tank H310 has an airtight structure, the inner part of the sub-tank H310 is not in communication with the atmosphere. Therefore, when the pump 311 is driven, the ink in the sub-tank H310 is sent to the main tank M303 through the second ink flow passage M3042, while the ink in the main tank M303 is sucked by the sub-tank H310 through the first ink flow passage M3041. In this manner, ink circulation is executed between the sub-tank H310 and the main tank M303.

The pressure inside the sub-tank H310 must be maintained in a negative pressure state so that the ink does not leak from the printhead H301. The pressure inside the sub-tank H310 is determined by the ink level of the main tank M303. It is preferable that the ink level of the main tank M303 be set at the position lower by 20 mm to 100 mm than the position of the printhead H301 (discharge orifice surface).

According to the above-described configuration, bubbles are generated in the first ink flow passage M3041 similarly to the conventional art shown in FIG. 15. However, the bubbles enter the sub-tank H310, flow through the second ink flow passage M3042, and end up being discharged to the main tank M303. Therefore, according to the above-described proposed configuration, the bubbles generated in midstream of the ink flow passage do not enter the sub-tank H310 in the printhead H301.

There is another conventional technique, which is disclosed in Japanese Patent Laid-Open No. 8-244250, for removing bubbles by circulating ink between a sub-tank and a main tank.

However, in the aforementioned plotters and medical image printers, there is a trend toward increasing types of ink for expressing more complicated tones.

For instance, in photographic color plotters, using more than six colors of ink, which include low-density cyan and magenta in addition to regular cyan, magenta, yellow, and black, has been proposed. Also, in medical image printers, at least six densities of black ink are necessary in order to print an image, for example, an X-ray image, where more than 1000 tones are necessary.

In a case where six types of ink are used, six ink supply systems must be provided, and twelve (6×2=12) ink flow passages are necessary between the sub-tank and the main tank.

As mentioned above, air from outside infiltrates the inner portion of the tube. It has also been confirmed that moisture and solvent in the ink evaporate outside the tube through the tube wall. Therefore, the more the number of ink flow passages between the sub-tank H310 and the main tank M303, the more the moisture and solvent evaporate, and as a result, the ink density changes. In a multi-tone image, particularly in an image having more than 1000 tones, accurate tone expression cannot be realized if the density of each ink changes.

Although the configuration for circulation shown in FIG. 16 can remove bubbles that get mixed inside the sub-tank H310 by a circulating operation, the circulating operation cannot be performed in the individual liquid chamber H309 provided below the sub-tank H310. To remove bubbles in the individual liquid chamber H309 which have been generated by printing or the like, a compression mechanism M306 is operated, and the individual liquid chamber bubbles H3091 are removed by running ink from the discharge orifice H306. This generates waste ink.

Furthermore, in the method of removing individual liquid chamber bubbles H3091 by running ink using the compression mechanism M306, there is a possibility that the sub-tank bubbles H3101 may move to the individual liquid chamber H309. When the bubbles pass through the filter H307, they become creamy fine bubbles. These fine bubbles tend to remain inside the individual liquid chamber H309 even if the compression mechanism M306 is operated. In fact, a large number of bubbles still may remain even after the recovery operation. In view of this, Japanese Patent Laid-Open No. 2000-301737 proposes a configuration for removing bubbles by providing a float valve inside the sub-tank. Moreover, Japanese Patent Laid-Open No. 11-320901 and No. 2006-095868 propose a configuration for removing air inside the sub-tank by providing a communication hole having a check valve in the ink chamber and releasing the check valve by a mechanism outside the printhead.

DISCLOSURE OF INVENTION

The printhead shown in FIG. 16 has plural ink chambers, and in particular comprises an individual liquid chamber H309 below the sub-tank H310 for supplying ink to the printing element substrate H308. A filter H307 is arranged between the two liquid chambers H310 and H309 to filter out impure substances in the ink which has been supplied from outside the printhead. Therefore, it is difficult for the conventional art to reliably remove as many bubbles as possible from each of the liquid chambers, in particular, from inside the individual liquid chamber H309 which is directly connected to the discharge orifice.

The present invention has been made in view of the above problem, and realizes a technique for reducing the amount of waste ink which is generated when bubbles remaining inside a printhead are discharged.

Furthermore, the present invention realizes a technique for, when bubbles remaining inside a printhead are to be discharged, reducing bubbles which move from the first ink chamber having an inlet port, which receives ink supply from an ink supply source, to the second ink chamber near the discharge orifice.

In order to solve the above problems, the present invention provides a printhead comprising a first ink chamber having an inlet port, to which ink from an ink supply source is supplied, a second ink chamber, to which the ink from the first ink chamber is supplied, a discharge orifice discharging ink from the second ink chamber, a first outlet port discharging fluid from the first ink chamber, a second outlet port discharging fluid from the second ink chamber, and an air-liquid separation unit which restricts liquid ejection and is provided at least either or both place between the first ink chamber and the first outlet port, or/and a place between the second ink chamber and the second outlet port, wherein flow resistance from the inlet port to the first outlet port is smaller than flow resistance from the inlet port to the second outlet port.

According to the present invention, it is possible to reduce the amount of waste ink which is generated when bubbles remaining inside the printhead are discharged.

Furthermore, when bubbles remaining inside the printhead are to be discharged, it is possible to reduce bubbles which move from the first ink chamber having an inlet port, which receives ink supply from an ink supply source, to the second ink chamber near the discharge orifice.

Further features of the present invention will become apparent from the following description of exemplary embodiments with reference to the attached drawings.

BRIEF DESCRIPTION OF DRAWINGS

The accompanying drawings, which are incorporated in and constitute part of the specification, illustrate embodiments of the invention and, together with the description, serve to explain the principles of the invention.

BEST MODE FOR CARRYING OUT THE INVENTION

First Embodiment

Figure 1:
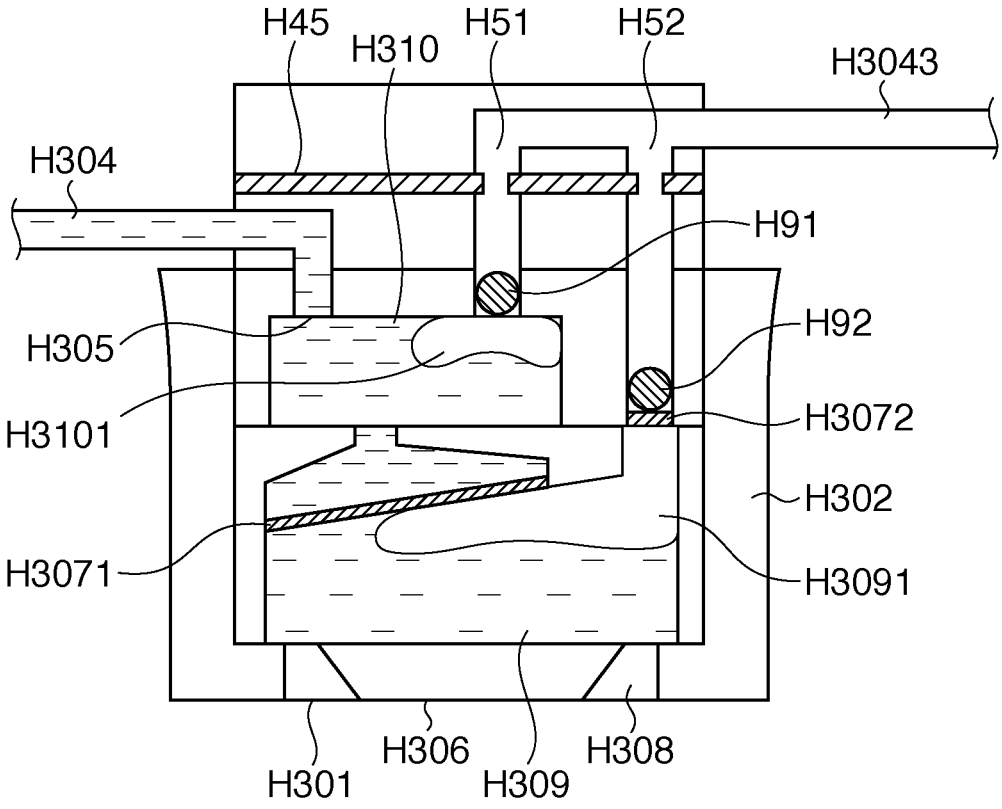
FIG. 1 is a diagram showing a configuration of an ink supply system of an inkjet printhead which represents the first embodiment of the present invention.

FIG. 1 shows a configuration of an ink supply system in an inkjet printhead, to which the present embodiment is applied.

As shown in FIG. 1, a carriage H302 holds a printhead H301 which discharges ink. The printhead H301 discharges ink from a discharge orifice H306 and performs printing while the carriage H302 moves in the main-scanning direction with respect to a print medium which is conveyed in the sub-scanning direction by a conveyance roller or the like.

As shown in FIG. 1, the printhead H301 is arranged so that ink from an ink flow passage H304 directly flows into a sub-tank H310, which serves as the first ink chamber in the printhead H301, through an inlet port H305. Below the sub-tank H310, an individual liquid chamber H309 serving as the second ink chamber is provided for holding ink to be introduced through an ink inlet filter H3071, serving as the first filter, to the discharge orifice H306.

The ink inlet filter H3071 is arranged at an angle with respect to the gravity direction. Because of this configuration, individual liquid chamber bubbles H3091, pooled inside the individual liquid chamber H309, can be gathered in one place. On the upper portion of the individual liquid chamber H309, an ink outlet filter H3072 which serves as the second filter is arranged in the place where bubbles are easily gathered because of the inclination.

On the upper portion of the sub-tank H310, the first air outlet port H51 (first outlet port) is provided for discharging bubbles. On the upper portion of the individual liquid chamber H309 which serves as the second ink chamber, the second air outlet port H52 (second outlet port) is provided for discharging bubbles. The first and second air outlet ports H51 and H52 are connected to a waste air-liquid flow passage H3043 which serves as a discharge passage. The waste air-liquid flow passage H3043 is connected to a pump M312 (FIG. 3), which serves as a decompression mechanism. By decompressing the waste air-liquid flow passage H3043 using the pump and vacuuming fluid from the first and second air outlet ports H51 and H52, bubbles are discharged from the sub-tank H310 and the individual liquid chamber H309.

Provided in the first air outlet port H51 is a sub-tank float valve mechanism consisting of a first float H91 (first float member) and a seal member H45 (first float seal member). The sub-tank float valve mechanism constitutes an air-liquid separation mechanism, which allows gas to discharge from the first air outlet port H51 and restricts liquid from discharging from the first air outlet port H51. The first float H91 is pressed against the seal member H45 because of the buoyancy of the float in the ink, thereby sealing the first air outlet port H51. Provided in the second air outlet port H52 is an individual liquid chamber float valve mechanism (second float valve mechanism) consisting of a second float H92 (second float member) and a seal member H45 (second float seal member). The second float valve mechanism is a second air-liquid separation mechanism. The second float H92 is pressed against the seal member H45 because of the buoyancy of the float in the ink, thereby sealing the second air outlet port H52.

Only one of the sub-tank float valve mechanism or the individual liquid chamber float valve mechanism may be provided.

When bubbles are to be discharged, the pump gives negative pressure to the waste air-liquid flow passage H3043. Bubbles pooled in the upper portion of the sub-tank H310 and individual liquid chamber H309 are vacuumed from the first and second air outlet ports H51 and H52. As the bubbles or gas are discharged, the ink surface in the sub-tank H310 and individual liquid chamber H309 rises, and along with the rise, the first and second floats H91 and H92, which have a smaller specific gravity than the ink, also rise. When the ink surface rises to the point close to the first and second air outlet ports H51 and H52, the first and second floats H91 and H92 are pressed against the seal member H45 because of the buoyancy of the floats in the ink. Since the floats block the ports before the ink surface becomes higher than the first and second air outlet ports H51 and H52, it is possible to restrict ink ejection and only the bubbles can be discharged.

The present embodiment is arranged in a way that the flow passage resistance from the ink inlet port to the first air outlet port H51 is smaller than the flow passage resistance from the ink inlet port to the second air outlet port H52. Note that the ink inlet port is where ink flows in from the ink flow passage H304.

Assume that Susmic Filter SH10H produced by Tokyo Rope Manufacturing Co., Ltd. is used as the filter member, and that the area of the ink inlet filter H3071 is 200 $mm^2$ while the area of the ink outlet filter H3072 is 50 $mm^2$. The following description is the case where ink having 4 cP viscosity flows at a flow rate of 0.5 ml/second. With the experimental values, about 145.8 mmAq pressure loss is generated in the ink inlet filter H3071 portion, and about 643.7 mmAq pressure loss is generated in the ink outlet filter H3072 portion. With the aforementioned conditions of ink viscosity and ink flow rate, the filters alone generate a pressure loss of about 789.5 (145.8+643.7) mmAq.

Therefore, by arranging the filters in the above-described manner, bubbles inside the sub-tank H310 can be removed before bubbles inside the individual liquid chamber are removed.

Other configurations may be adopted to make the flow passage resistance from the ink inlet port to the first air outlet port H51 smaller than the flow passage resistance from the ink inlet port to the second air outlet port H52. For instance, the cross-sectional area of the ink flow passage from the sub-tank H310 to the first air outlet port H51 (flow passage of the float valve mechanism H4A) may be made larger than the cross-sectional area of the ink flow passage from the liquid chamber H309 to the second air outlet port H52 (flow passage of the float valve mechanism H4B).

Alternatively, the length of the ink flow passage from the sub-tank H310 to the first air outlet port H51 (flow passage of the float valve mechanism H4A) may be made shorter than the length of the ink flow passage from the liquid chamber H309 to the second air outlet port H52 (flow passage of the float valve mechanism H4B).

Figure 2A:
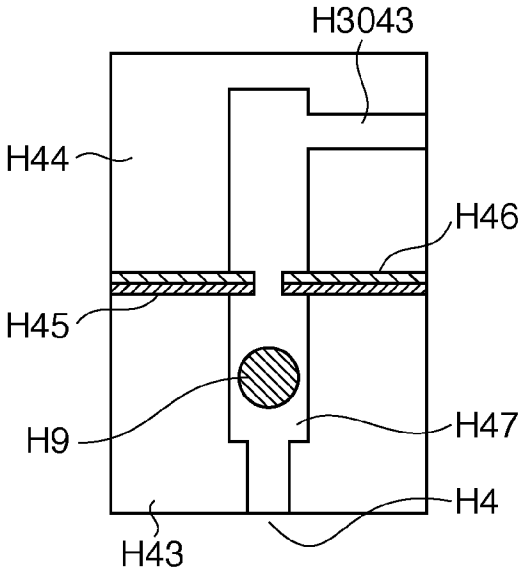
FIGS. 2A to 2C are detailed views showing a configuration of a float valve mechanism.

A detailed configuration of the float valve mechanism according to the present embodiment is shown in FIG. 2. As shown in FIG. 2A, the float valve mechanism H4 comprises a float housing H43 and a float upper housing H44. In the float housing H43, there is a float chamber H47 where a float H9 is movably housed. At the fluid outlet of the float chamber H47, a seal member H45 is provided. When the float chamber H47 is filled with liquid, the lifted float H9 comes in contact with the float seal member H45, thereby blocking the passage from the float chamber H47 to the waste air-liquid flow passage H3043 through the air outlet ports H51 and H52.

Figure 2B:
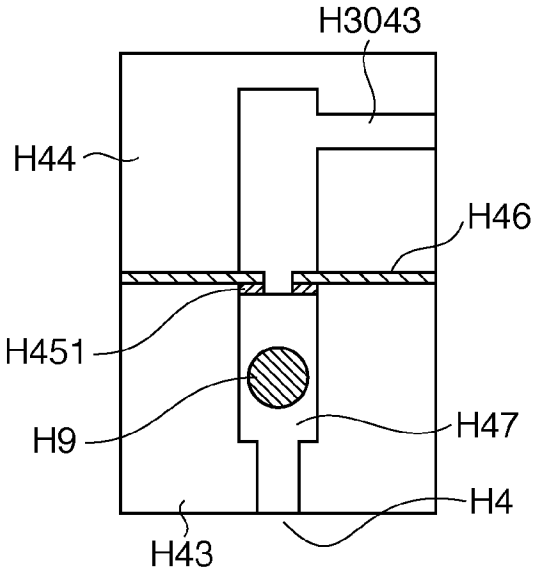
Figure 2C:
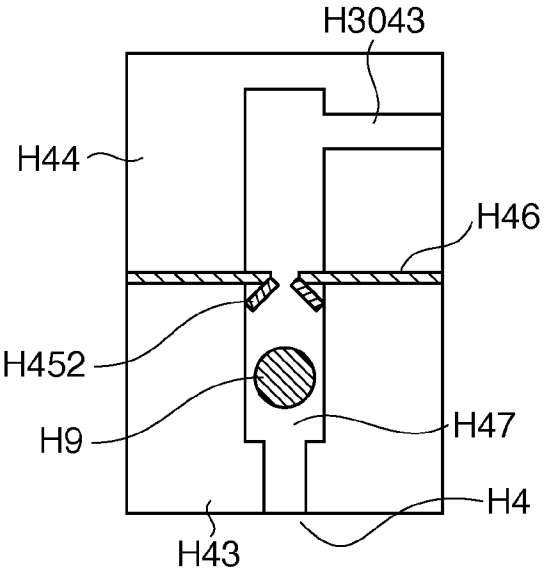

The air moved from each of the liquid chambers to the float valve mechanism H4 is removed through the waste air-liquid flow passage H3043. As shown in FIGS. 2B and 2C, the sealing portion of the float valve mechanism may be of an O-ring H451 or a taper seal member H452.

Figure 3:
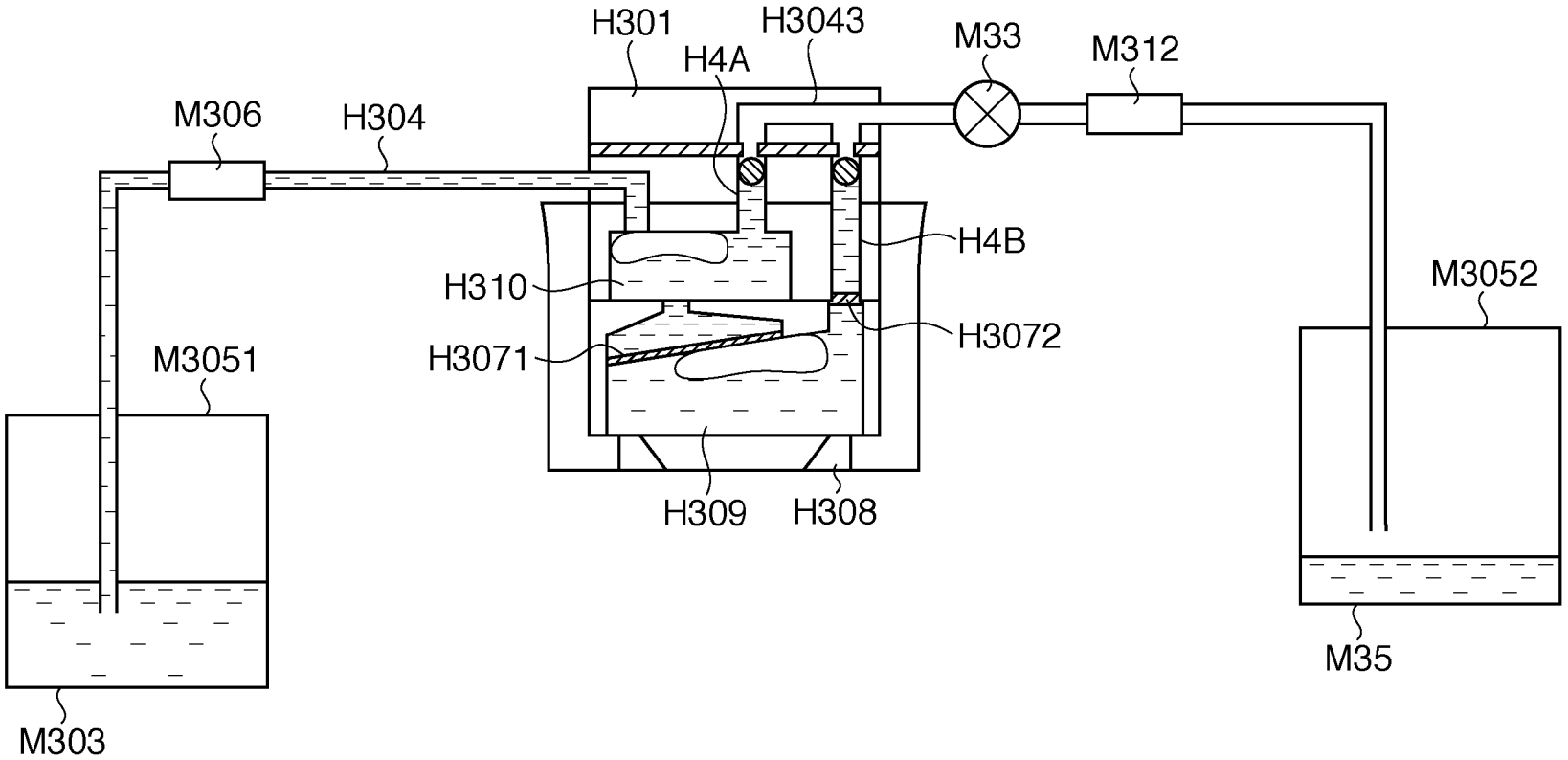
FIG. 3 is a diagram showing an overall configuration of the ink supply system of an inkjet printing apparatus according to the first embodiment of the present invention.

The overall configuration of the ink supply system of an inkjet printer, to which the present embodiment is applied, is shown in FIG. 3.

As shown in FIG. 3, the printhead H301 is connected with the main tank M303, which serves as an ink supply source, through the ink flow passage H304. Between the main tank M303 and the printhead H301, a compression mechanism M306 may be arranged. Ink from the ink flow passage H304 enters the sub-tank H310 in the printhead H301, then an impure substance is filtered out by the ink inlet filter H3071, and the ink enters the individual liquid chamber H309. The ink in the individual liquid chamber H309 is introduced to a printing element substrate H308 arranged on the bottom portion of the individual liquid chamber H309. The ink outlet filter H3072 is arranged in the neighborhood of the top portion of the individual liquid chamber H309. Above the ink outlet filter H3072, the float valve mechanism H4 is arranged. Bubbles and waste liquid flow to the waste air-liquid flow passage H3043 through the float valve mechanism H4. The waste air-liquid flow passages H3043 provided respectively above the sub-tank float valve mechanism H4A and the individual liquid chamber float valve mechanism H4B are integrated inside the printhead, and connected to the main-body's waste air-liquid flow passage H3043 outside the printhead as one system. In the printer main body, a waste ink tank M35 is provided. In the main-body's waste air-liquid flow passage H3043 between the printhead H301 and the waste ink tank M35, a waste air-liquid pump M312 which is necessary for giving negative pressure to the printhead is arranged, and is driven when executing an air removal operation.

Figure 4:
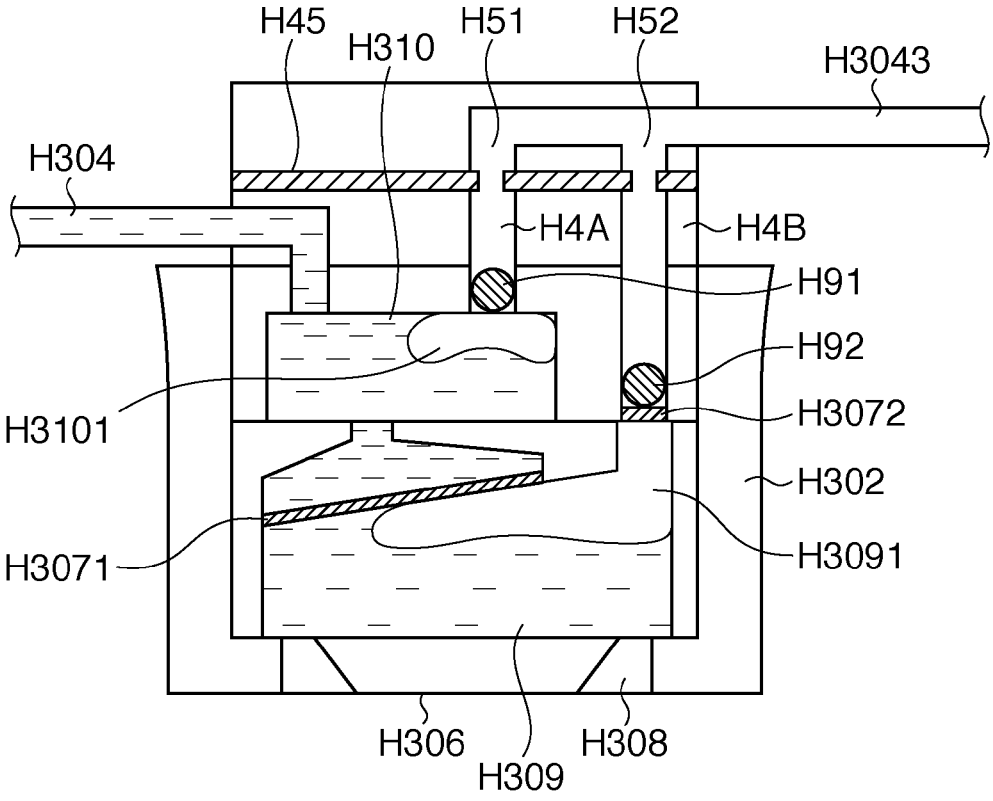
FIG. 4 is a diagram showing the ink flow inside the printhead at the time of air removal according to the first embodiment of the present invention.
Figure 5:
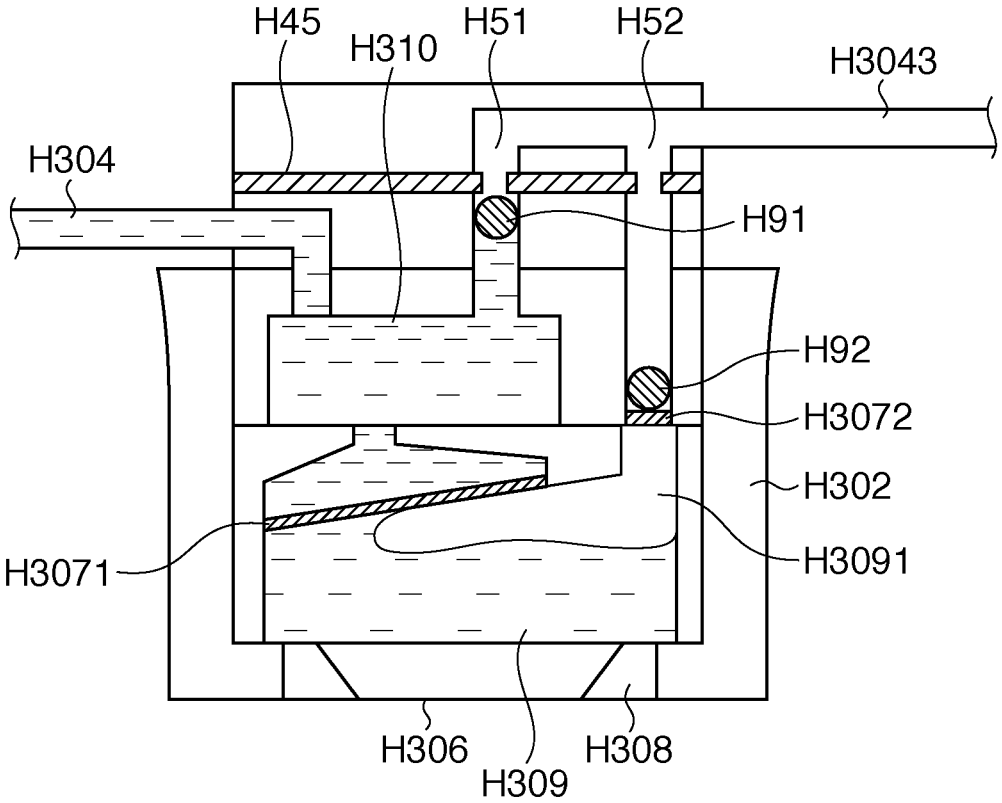
FIG. 5 is a diagram showing the ink flow inside the printhead at the time of air removal according to the first embodiment of the present invention.
Figure 6:
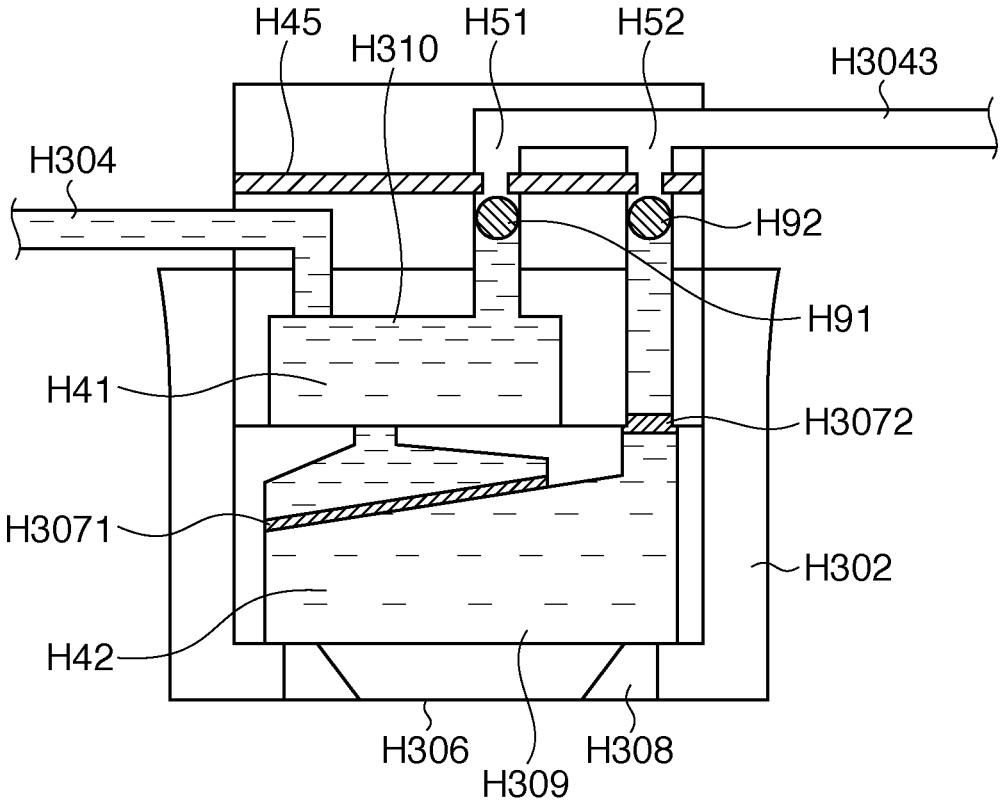
FIG. 6 is a diagram showing the ink flow inside the printhead at the time of air removal according to the first embodiment of the present invention.

The ink flow in the printhead at the time of executing an air removal operation is shown in FIGS. 4 to 6. In the initial state as shown in FIG. 4, the bubbles H3101 and H3091 exist in the sub-tank H310 and the individual liquid chamber H309. First, the waste air-liquid pump M312 is driven. As mentioned above, the flow passage resistance from the ink flow passage H304 to the sub-tank float valve mechanism H4A is smaller than the flow passage resistance from the ink flow passage H304 to the individual liquid chamber float valve mechanism H4B. Therefore, when the waste air-liquid pump M312 is driven, an air removal operation of the sub-tank H310 which has the smaller flow passage resistance is first executed, and air in the sub-tank H310 is removed as shown in FIG. 5. After the air removal in the sub-tank H310 is completed, the float H91 of the sub-tank float valve mechanism H4A comes in contact with the seal member H45, thereby sealing the air outlet port.

With this state, the waste air-liquid pump M312 is kept driven. The air removal operation is executed to remove air in the individual liquid chamber H309 through the individual liquid chamber float valve mechanism H4B. Ultimately, air can be removed from both the sub-tank H310 and the individual liquid chamber H309 as shown in FIG. 6.

According to the configuration of the present embodiment, since bubbles in the individual liquid chamber H309 can be removed after bubbles in the sub-tank H310 are removed, bubbles in the sub-tank H310 no longer get inside the individual liquid chamber H309. In other words, it is possible to prevent such situation where the bubbles passing through the ink inlet filter H3071 turn into fine bubbles in the individual liquid chamber H309 and become difficult to remove. Furthermore, a relief valve M33 which serves as an atmospheric air communication mechanism is arranged between the waste air-liquid pump M312 and the printhead H301 so that the sub-tank float valve mechanism H4A and the individual liquid chamber float valve mechanism H4B can be released to the atmospheric air. Compared to the conventional recovery method which has produced a large amount of waste ink, according to the above-described configuration, it is possible to reduce the amount of waste ink and remove as many bubbles as possible from the sub-tank H310 and the individual liquid chamber H309.

Second Embodiment

Figure 7:
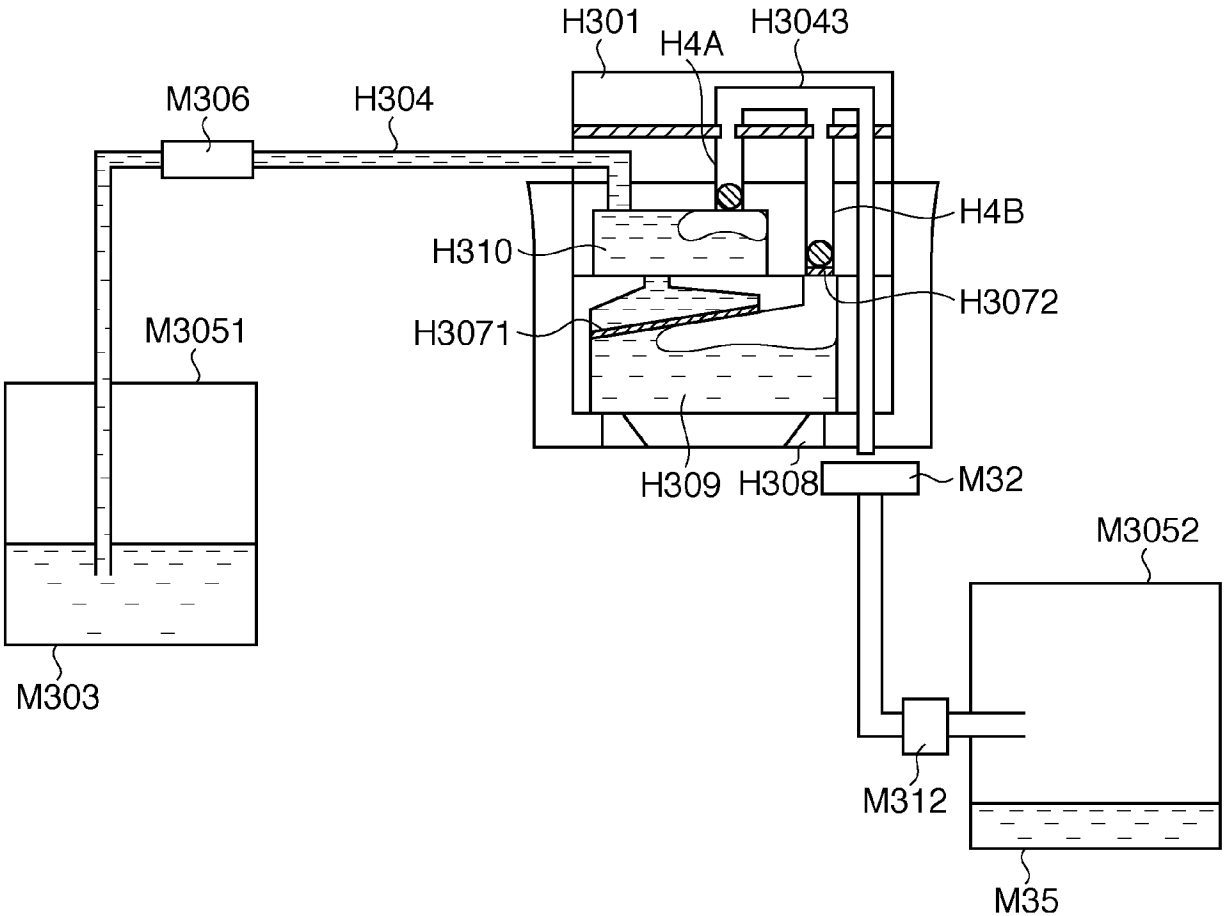
FIG. 7 is a diagram showing an overall configuration of a supply system in an inkjet printing apparatus according to the second embodiment of the present invention.

Shown in FIG. 7 is an overall configuration of a supply system according to the second embodiment in an inkjet printing apparatus, to which the present invention is applied. As shown in FIG. 7, the printhead H301 is connected with the main tank M303 through the ink flow passage H304. Between the main tank M303 and the printhead H301, a compression mechanism M306 may be arranged.

Ink from the ink flow passage H304 enters the sub-tank H310 in the printhead H301, then an impure substance is filtered out by the ink inlet filter H3071, and the ink enters the individual liquid chamber H309. The ink in the individual liquid chamber H309 is introduced to a printing element substrate H308 arranged on the bottom portion of the individual liquid chamber H309. The ink outlet filter H3072 is arranged in the neighborhood of the top portion of the individual liquid chamber H309. Above the sub-tank H310, a sub-tank float valve mechanism H4A is arranged.

Above the ink outlet filter H3072, an individual liquid chamber float valve mechanism H4B is arranged. Bubbles and waste liquid flow to the waste air-liquid flow passage H3043 through the float valve mechanism H4.

In the present embodiment, the waste air-liquid flow passage H3043 is arranged inside the printhead H301, and is introduced to the surface, where the discharge orifice H306 is provided, then to the opening which is provided on the bottom surface of the printhead H301. In the apparatus main body, a cap M32 is provided at the position facing the ink discharge surface. Further provided are the main body's waste air-liquid flow passage H3043 for discharging bubbles and waste liquid from the cap M32, and the waste ink tank M35. Provided in midstream of the main body's waste air-liquid flow passage H3043 is a waste air-liquid pump M312 that can give negative pressure to the printhead H301 through the cap M32.

When an air discharge operation using the float valve mechanism H4 is executed, the cap M32 is firmly attached to the opening. By driving the waste air-liquid pump M312, air can be removed from the float valve mechanism H4. Compared to the conventional recovery method which has produced a large amount of waste ink, according to the above-described configuration having the float valve mechanism H4, it is possible to reduce the amount of waste ink. Also, by virtue of the configuration for removing air from the float valve mechanism using the suction cap M32, the apparatus main body can be downsized.

Third Embodiment

Figure 8:
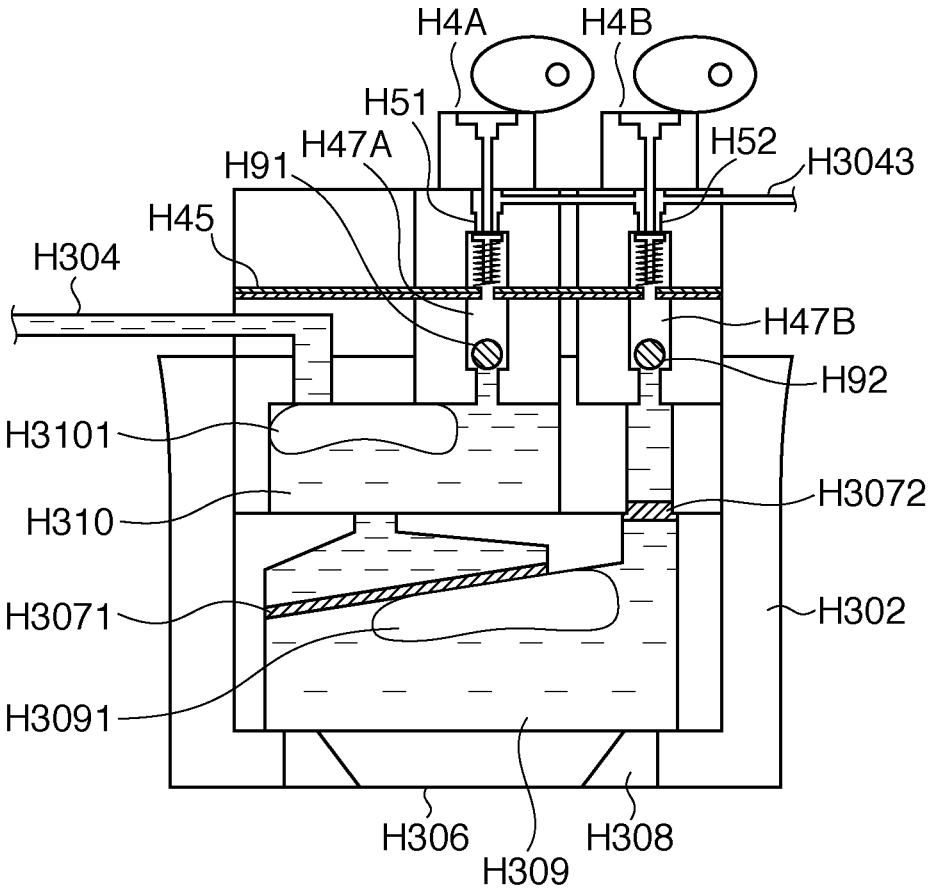
FIG. 8 is a diagram showing a configuration of an ink supply system of an inkjet printhead according to the third embodiment of the present invention.

The third embodiment, to which the present invention is applied, is shown in FIG. 8. As shown in FIG. 8, the carriage H302 holds the printhead H301 which discharges ink. A print operation on a print medium, which is not shown in the drawing, is executed by scanning the carriage in the main-scanning direction and discharging ink to the print medium while the print medium is conveyed in the sub-scanning direction by a print medium conveyance roller or the like which is not shown in the drawing.

As shown in FIG. 8, the printhead H301 is arranged so that ink from the ink flow passage H304 directly flows into the sub-tank H310. Below the sub-tank H310, the individual liquid chamber H309 is provided for holding ink to be introduced through the ink inlet filter H3071 to the discharge orifice H306. The ink inlet filter H3071 is arranged at an angle with respect to the gravity direction. Because of this configuration, individual liquid chamber bubbles H3091, pooled inside the individual liquid chamber H309, can be gathered in one place. On the upper portion of the individual liquid chamber H309, the ink outlet filter H3072 is arranged in the place where bubbles are easily gathered because of the inclination.

In the printhead H301 having the above-described configuration, a sub-tank float valve mechanism H4A and an individual liquid chamber float valve mechanism H4B are arranged respectively above the sub-tank H310 and the ink outlet filter H3072.

The sub-tank float valve mechanism H4A comprises a first float chamber H47A, where the first float H91 is movably housed, between the sub-tank H310 and the first air outlet port H51. The individual liquid chamber float valve mechanism H4B comprises a second float chamber H47B, where the second float H92 is movably housed, between the individual liquid chamber H309 and the second air outlet port H52.

Figure 9A:
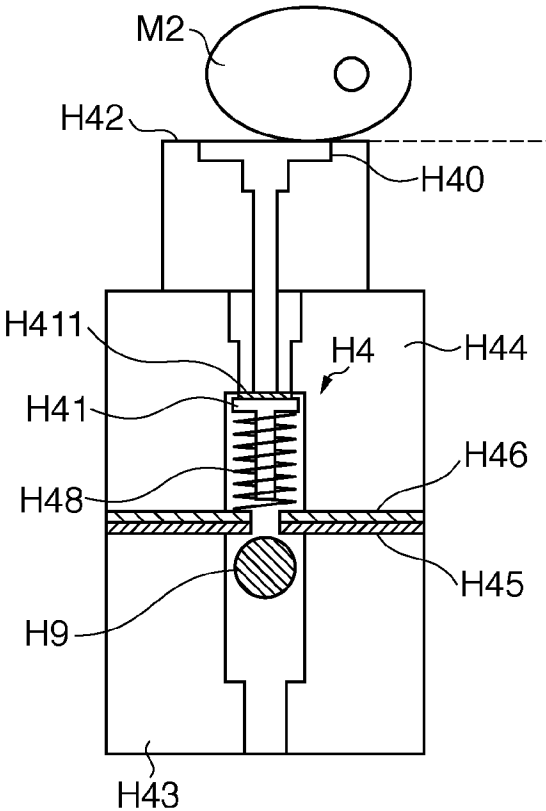
FIGS. 9A to 9C are detailed views showing a configuration of a float valve mechanism in the inkjet printhead according to the third embodiment of the present invention.

A detailed configuration of each float valve mechanism H4 according to the present embodiment is shown in FIG. 9A. As shown in FIG. 9A, the float valve mechanism H4 comprises a float housing H43 and a float upper housing H44. In the float upper housing H44, an opening/closing valve H41 which has a downward projection is provided for atmospheric air communication control. The opening/closing valve provided in the upper portion of the first float chamber H47A is a first opening/closing valve. The opening/closing valve provided in the upper portion of the second float chamber H47B is a second opening/closing valve. Between the opening/closing valve H41 and a seal keeping member H46, a spring member H48 is arranged. On top of the opening/closing valve H41, a depressing mechanism H40 is arranged. The float valve mechanism H4 is sealed by flexible film H42.

In the downstream of the opening/closing valve H41, the waste air-liquid flow passage H3043 is provided. Air moved from the sub-tank H310 or individual liquid chamber H309 to the float valve mechanism H4 is removed through the waste air-liquid flow passage H3043. Above the depressing mechanism H40, a depressing member M2, such as a cam, is arranged outside the printhead, and driven by a driving source which is not shown in the drawing.

Next described is an operation when the depressing member M2 is driven to drive the float valve mechanism H4. When the depressing member M2 is not driven, the float upper housing H44 is attached firmly to the opening/closing valve seal portion H411 by the spring member H48 so that the negative pressure in the printhead H301 is maintained.

Figure 9B:
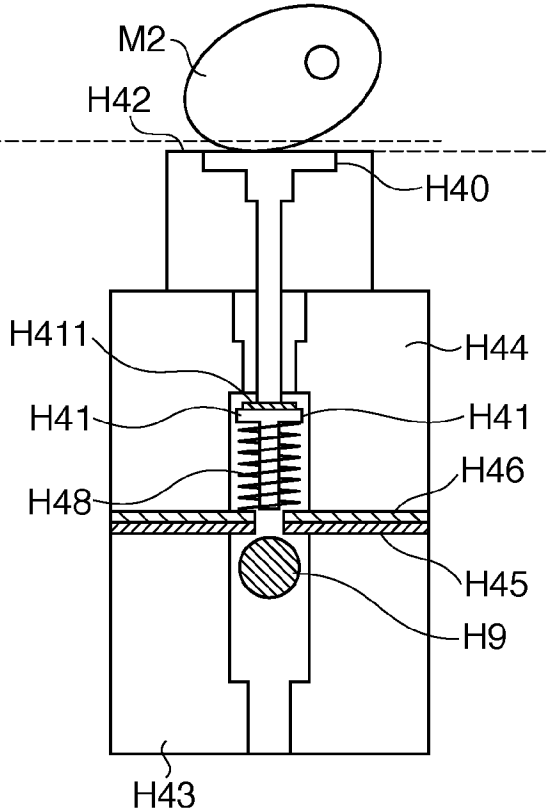
Figure 9C:
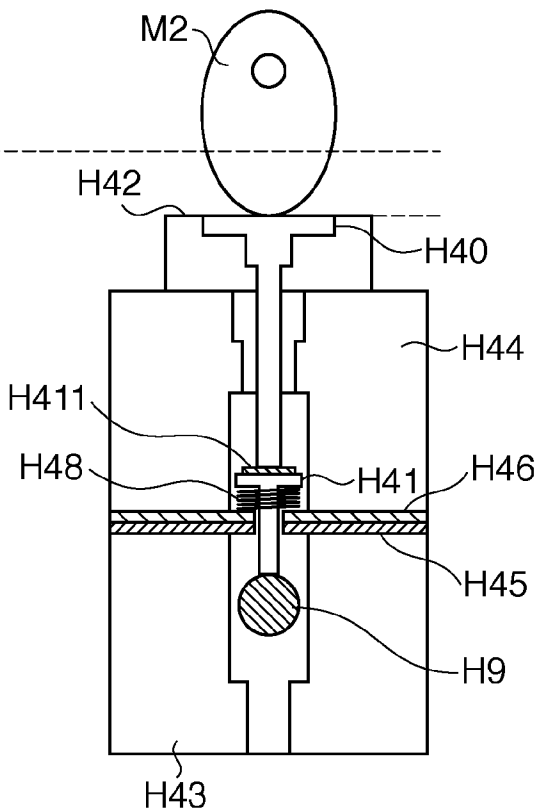

When a bubble removal operation is to be executed, as shown in FIG. 9B the depressing member M2 is driven to push the depressing mechanism H40 downward, thereby opening the opening/closing valve H41. Moreover, the depressing mechanism H40 can be pushed down further as shown in FIG. 9C. By this operation, a depressing rod at the bottom end of the depressing mechanism H40 can detach the float H9, which has been attached to the seal member H45, apart from the seal member H45. Releasing the opening/closing valve H41 is realized at the same time as detaching the float H9 from the seal member H45. The depressing mechanism H40 constitutes the detaching mechanism which detaches the float H9 from the seal member H45. The mechanism acting on the first float is the first detaching mechanism, while the mechanism acting on the second float is the second detaching mechanism.

Figure 10:
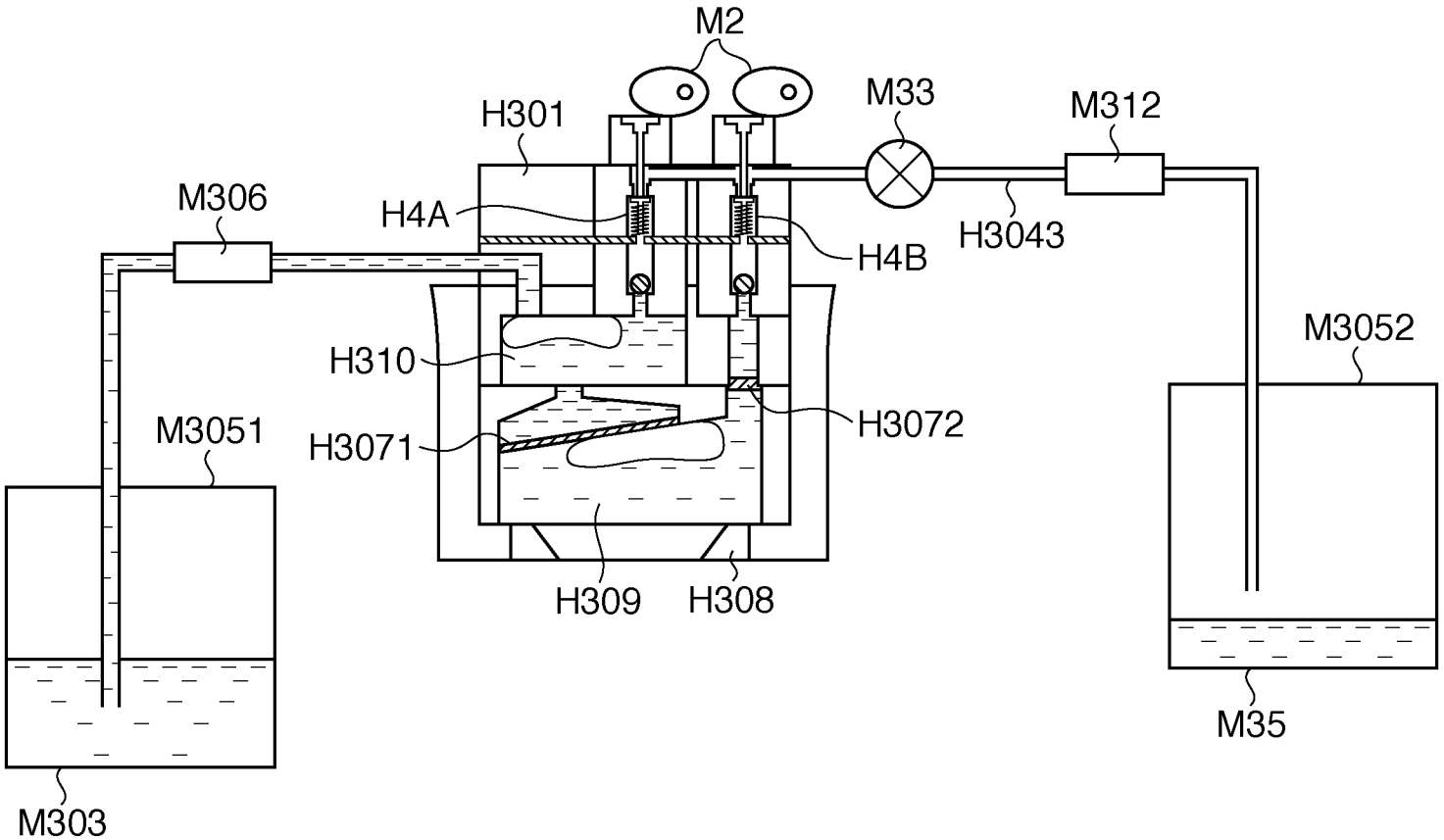
FIG. 10 is a diagram showing an overall configuration of a supply system according to the third embodiment of the present invention.

Shown in FIG. 10 is an overall configuration of a supply system of an inkjet printing apparatus, to which the present embodiment is applied. As shown in FIG. 10, the printhead H301 is connected with the main tank M303 through the ink flow passage H304. Between the main tank M303 and the printhead H301, a compression mechanism M306 may be arranged. Ink from the ink flow passage H304 enters the sub-tank H310 in the printhead H301, then an impure substance is filtered out by the ink inlet filter H3071, and the ink enters the individual liquid chamber H309. The ink in the individual liquid chamber H309 is introduced to the printing element substrate H308 arranged on the bottom portion of the individual liquid chamber H309.

The ink outlet filter H3072 is arranged in the neighborhood of the top portion of the individual liquid chamber H309. Above the ink outlet filter H3072, an individual liquid chamber float valve mechanism H4B is arranged. Above the sub-tank H310, a sub-tank float valve mechanism H4A is arranged. Bubbles and waste liquid flow to the waste air-liquid flow passage H3043 through the float valve mechanism H4. The waste air-liquid flow passages H3043 provided respectively above the sub-tank float valve mechanism H4A and the individual liquid chamber float valve mechanism H4B are integrated inside the printhead, and connected to the main-body's waste air-liquid flow passage H3043 outside the printhead as one system.

In the printer main body, a waste ink tank M35 is provided. In the main-body's waste air-liquid flow passage H3043 between the printhead H301 and the waste ink tank M35, a waste air-liquid pump M312 which is necessary for giving negative pressure to the printhead H301 is arranged, and is driven when executing an air removal operation.

When the air removal operation is completed, the depressing members M2, which are provided respectively above the sub-tank float valve mechanism H4A and the individual liquid chamber float valve mechanism H4B, are driven. Driving the depressing members M2 pushes the float H9 which may have been attached to the seal member H45, and executes an attachment prevention operation to prevent the float H9 from being attached to the seal member H45. Furthermore, a relief valve M33 which serves as an atmospheric air communication mechanism is arranged between the waste air-liquid pump M312 and the printhead H301 so that the printhead H301 can be released to the atmospheric air.

In the conventional recovery method, a large amount of waste ink is generated. However, according to the above-described configuration which comprises the float valve mechanisms H4A and H4B using the depressing mechanism M2, it is possible to reduce the amount of waste ink. Furthermore, by virtue of eliminating malfunction caused by the float H9 being attached to the seal member H45, and providing the opening/closing valve H41 inside the float valve mechanism H4, it is possible to downsize the apparatus.

Fourth Embodiment

Figure 11B:
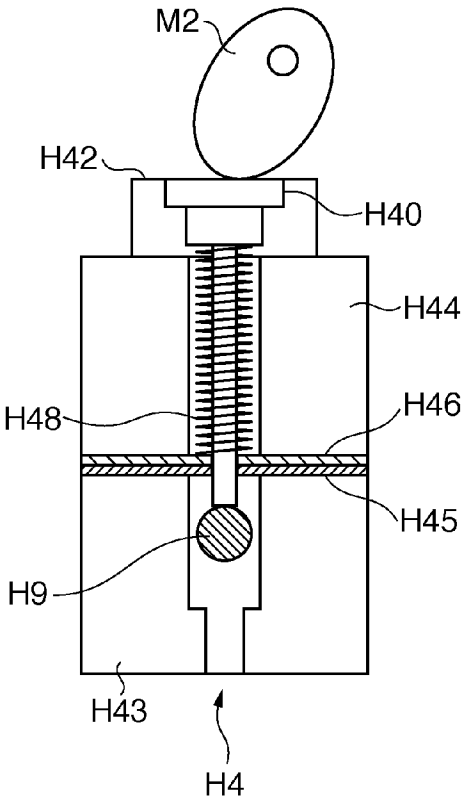
FIGS. 11A and 11B are detailed views showing a configuration of a float valve mechanism according to the fourth embodiment of the present invention.
Figure 11A:
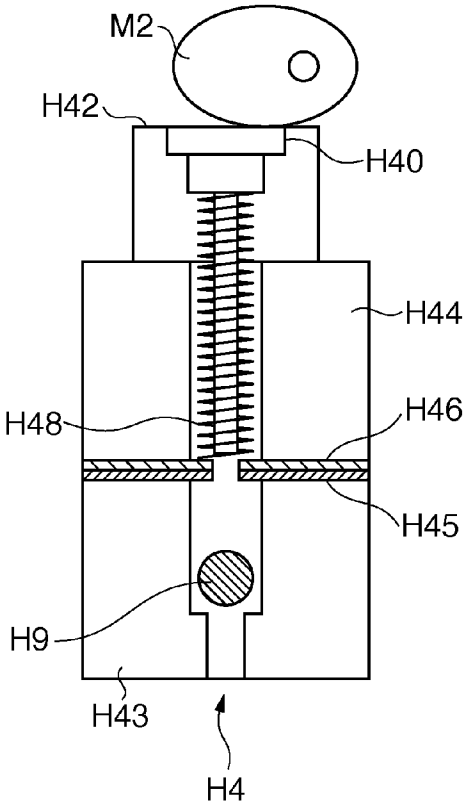

The fourth embodiment of the float valve mechanism, to which the present invention is applied, is shown in FIGS. 11A and 11B.

As shown in FIG. 11A, each float valve comprises a float housing H43 and a float upper housing H44. Between the depressing mechanism H40 and the seal keeping member H46, a spring member H48 is arranged. The float valve mechanism H4 is sealed by flexible film H42. In the downstream of the float H9, the waste air-liquid flow passage H3043 is provided so that air moved from the sub-tank H310 or individual liquid chamber H309 to the float valve mechanism H4 is removed through the waste air-liquid flow passage H3043. Above the depressing mechanism H40, a depressing member M2, such as a cam, is arranged outside the printhead, and driven by a driving source which is not shown in the drawing.

As shown in FIG. 11B, the depressing member M2 is driven to push the depressing mechanism H40 downward. By this operation, the float H9 which has been attached to the seal member H45 can be detached, and as a result, a highly reliable float valve system can be realized.

Fifth Embodiment

Figure 12:
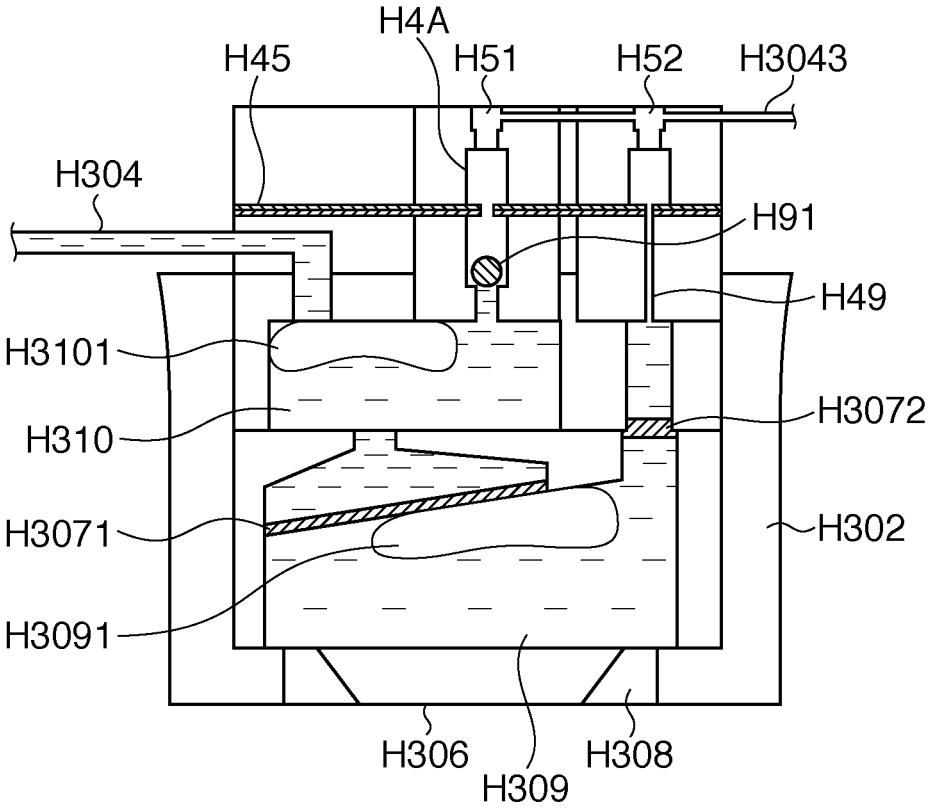
FIG. 12 is a diagram showing a configuration of an ink supply system of an inkjet printhead according to the fifth embodiment of the present invention.

FIG. 12 shows an overall configuration of a supply system according to the fifth embodiment in an inkjet printing apparatus, to which the present invention is applied. As shown in FIG. 12, the carriage H302 holds the printhead H301 which discharges ink. A print operation on a print medium, which is not shown in the drawing, is executed by scanning the carriage in the main-scanning direction and discharging ink to the print medium while the print medium is conveyed in the sub-scanning direction by a print medium conveyance roller or the like which is not shown in the drawing. As shown in FIG. 12, the printhead H301 is arranged so that ink from the ink flow passage H304 directly flows into the sub-tank H310. Below the sub-tank H310, the individual liquid chamber H309 is provided for holding ink to be introduced through the ink inlet filter H3071 to the discharge orifice H306. The ink inlet filter H3071 is arranged at an angle with respect to the gravity direction. Because of this configuration, individual liquid chamber bubbles H3091, pooled inside the individual liquid chamber H309, can be gathered in one place.

On the upper portion of the individual liquid chamber H309, the ink inlet filter H3071 is arranged in the place where bubbles are easily gathered because of the inclination. In the printhead H301 having the above-described configuration, a sub-tank float valve mechanism H4A is arranged above the sub-tank H310. However, no float valve mechanism is provided above the ink outlet filter H3072 of the individual liquid chamber H309. Instead, a flow resistance increasing mechanism H49 is provided. The flow resistance increasing mechanism H49 is consisted of a narrow flow passage and a plurality of filters in the flow passage. In this embodiment, when the waste air-liquid pump M312 is driven, air inside the sub-tank H310 is first removed by the sub-tank float valve mechanism H4A, thereafter the air inside the individual liquid chamber H309 is removed together with ink. By virtue of having the aforementioned flow resistance increasing mechanism H49, the air inside the individual liquid chamber H309 can be removed with little amount of waste ink without requiring a special mechanism.

Sixth Embodiment

Figure 13:
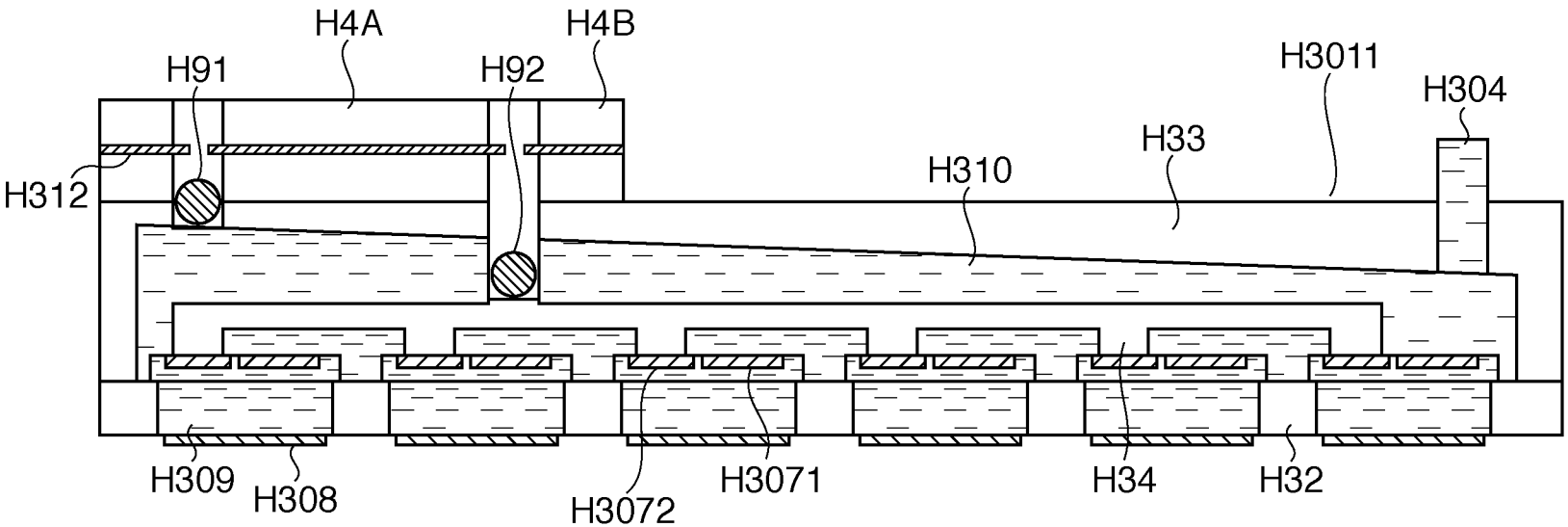
FIG. 13 is a diagram showing a configuration of an ink supply system of a full-line inkjet printhead according to the sixth embodiment of the present invention.

FIG. 13 shows an overall configuration of a supply system of an inkjet printing apparatus, to which the present invention is applied.

As shown in FIG. 13, a plurality of printing element substrates H308 are arranged serially or in a staggered manner on a supporting substrate H32 in the printhead H3011 according to the present embodiment. The printhead is a full-line inkjet printhead where ink discharge orifices are arranged throughout the entire width of a print paper.

At the position opposite to each of the printing element substrates H308 on the supporting substrate H32, the aforementioned individual liquid chamber H309 which supplies ink to the printing element substrate H308 is provided. Above the supporting substrate H32, a chip tank H33 is arranged in a way that a sub-tank H310 is formed between the chip tank H33 and the supporting substrate H32. In the chip tank H33, there is an ink flow passage H304 which is connected to the external main tank M303. The ink inlet filter H3071 is arranged between the sub-tank H310 and each of the plurality of individual liquid chambers H309 to filter out an impure substance, which gets in from outside the printhead, from the ink which is to be supplied to the printing element substrates H308.

Furthermore, the ink outlet filter H3072 is provided on the upper portion of each of the individual liquid chambers H309. Air or ink discharged from the ink outlet filter H3072 is integrated respectively in an individual liquid chamber waste air-liquid flow passage H34, and moved to the ink tank M35 outside the printhead by the individual liquid chamber float valve mechanism H4B.

The ink outlet filter H3072 may be arranged in each of the individual liquid chambers H309 as mentioned above, or one ink outlet filter H3072 may be provided somewhere between the individual liquid chamber float valve mechanism H4B and the individual liquid chamber waste air-liquid flow passage H34 where discharged air or ink is integrated. Note that the ink outlet filter H3072 is not necessarily required.

The full-line printhead H3011 having the above-described configuration is constructed in a way that the flow passage resistance from the ink flow passage H304 to the first air outlet port H51 is smaller than the flow passage resistance from the ink flow passage H304 to the second air outlet port H52. By virtue of this configuration, bubbles in the individual liquid chamber H309 can be removed by the float valve mechanism H4 after bubbles in the sub-tank H310 are removed. Because the float valve mechanism H4 is used, bubbles can be removed with a reduced amount of waste liquid, and bubbles in the sub-tank H310 no longer get inside the individual liquid chamber H309. Therefore, it is possible to reliably remove as many bubbles as possible from the individual liquid chamber H309.

Seventh Embodiment

Figure 14:
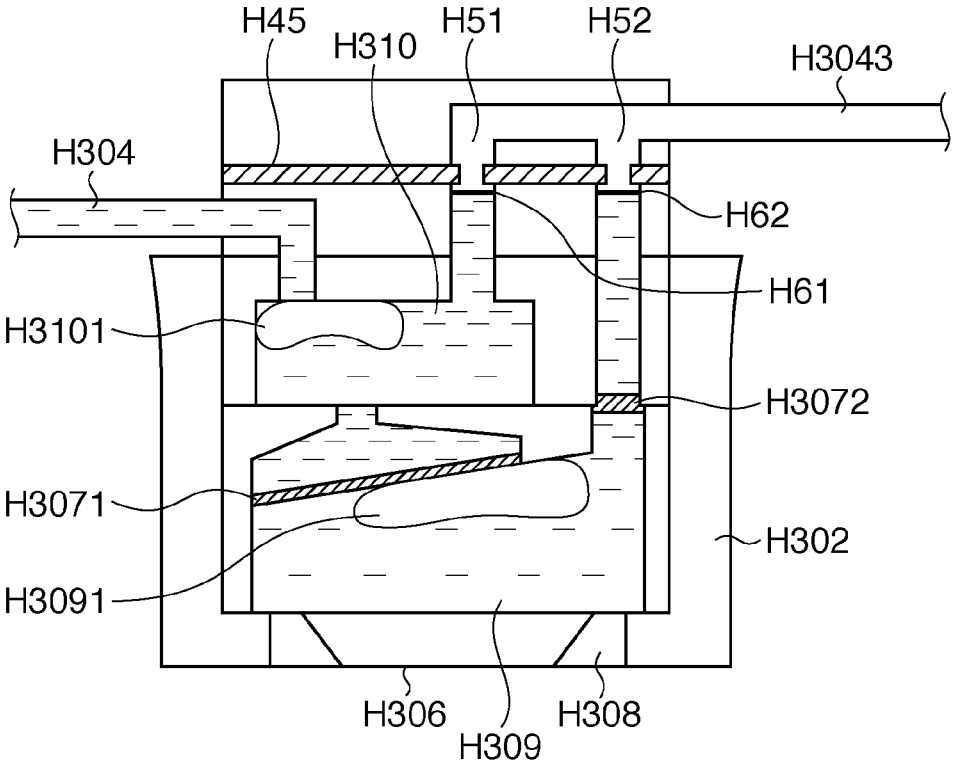
FIG. 14 is a diagram showing a configuration of an ink supply system of an inkjet printhead according to the seventh embodiment of the present invention.
Figure 15:
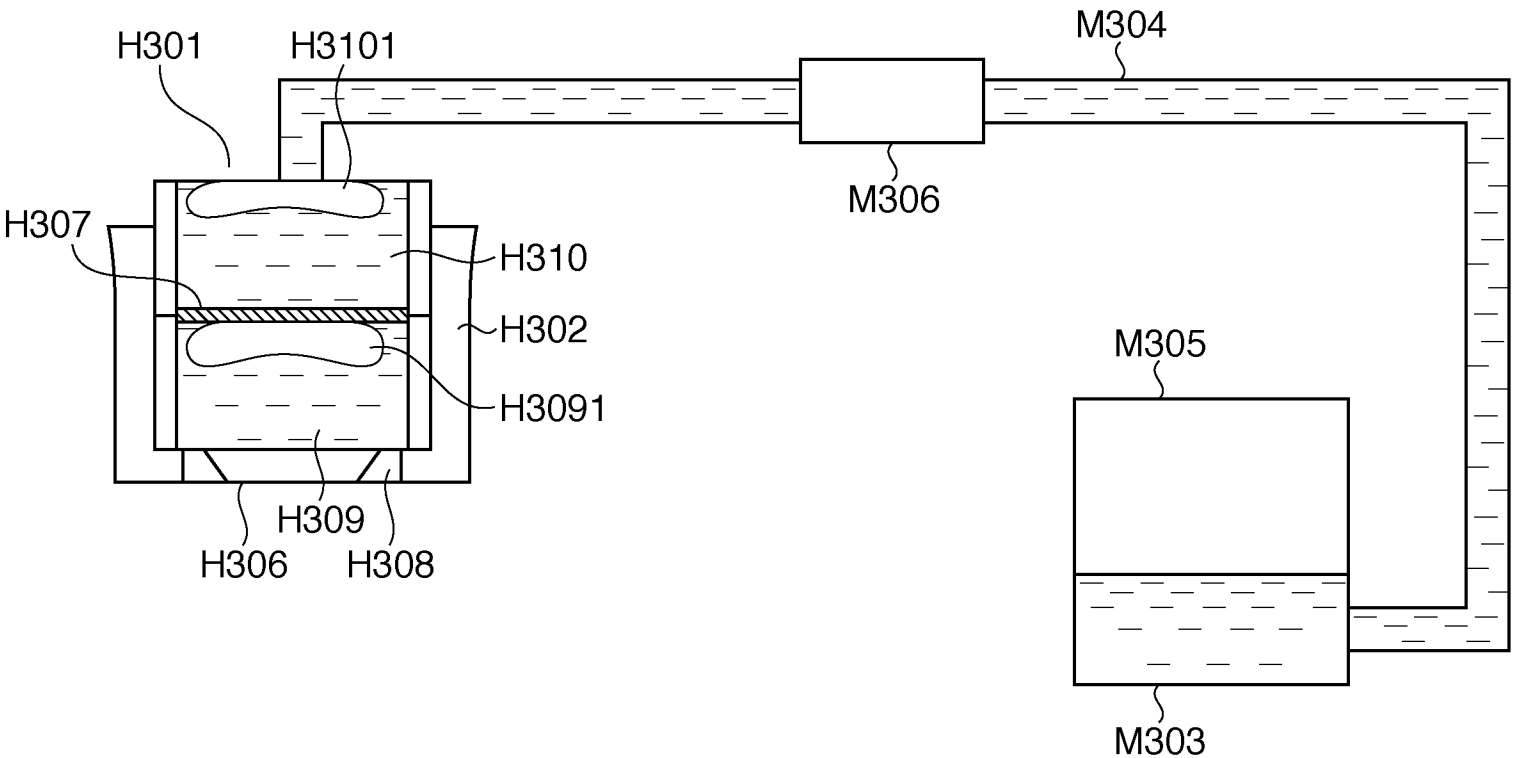
FIG. 15 is a schematic diagram of an ink supply system in a conventional inkjet printing apparatus.
Figure 16:
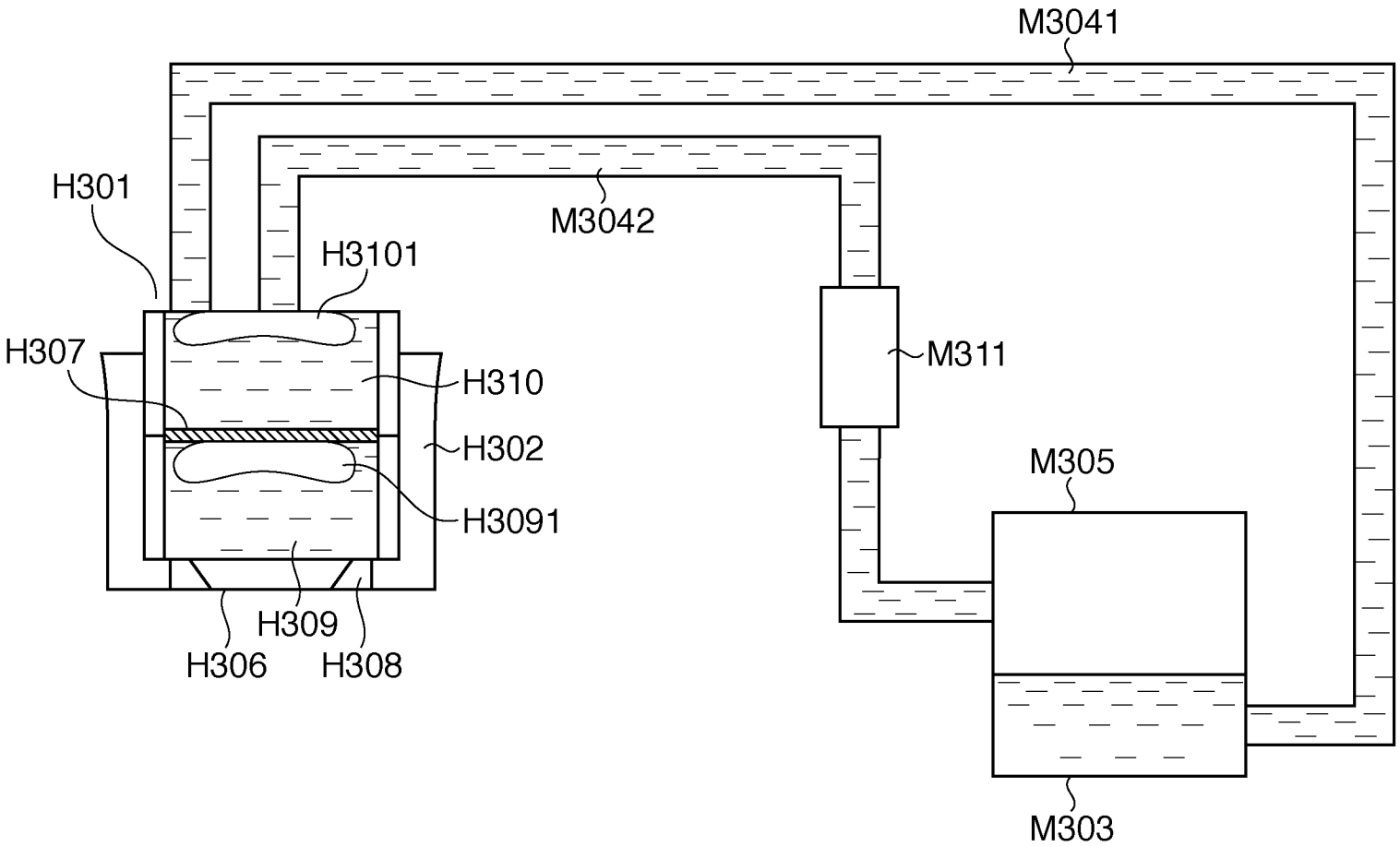
FIG. 16 is a schematic diagram of another ink supply system in a conventional inkjet printing apparatus.

The seventh embodiment to which the present invention is applied is shown in FIG. 14. As shown in FIG. 14, the printhead H301 is arranged so that ink from the ink flow passage H304 directly flows into the sub-tank H310.

Below the sub-tank H310, the individual liquid chamber H309 is provided for holding ink to be introduced through the ink inlet filter H3071 to the discharge orifice H306. Further, the ink inlet filter H3071 is arranged at an angle with respect to the gravity direction so that the individual liquid chamber bubbles H3091, pooled inside the individual liquid chamber H309, can be gathered in one place.

On the upper portion of the individual liquid chamber H309, an ink outlet filter H3072 is arranged in the place where bubbles are easily gathered because of the inclination. In the printhead H301 having the above-described configuration, the first and second air-liquid separation film H61 and H62 are arranged respectively above the sub-tank H310 and the ink outlet filter H3072. By giving negative pressure to the waste air-liquid flow passage H3043 using the waste air-liquid pump M312, bubbles accumulated in the lower side of the first and second air-liquid separation film H61 and H62 can be removed.

Furthermore, the flow passage from the first air-liquid separation film H61 to the waste air-liquid flow passage H3043 and the flow passage from the second air-liquid separation film H62 to the waste air-liquid flow passage H3043 join together along the way. The first air outlet port H51 is provided at the flow passage exit of the sub-tank H310, while the second air outlet port H52 is provided at the flow passage exit of the ink outlet filter.

The printhead according to the present embodiment is also constructed in a way that the flow resistance from the ink flow passage H304 to the first air outlet port H51 is smaller than the flow resistance from the ink flow passage H304 to the second air outlet port H52. By virtue of this configuration, bubbles in the individual liquid chamber H309 can be removed after bubbles in the sub-tank H310 are removed. In other words, because the air-liquid separation film H61 and H62 are used, bubbles can be removed with a reduced amount of waste liquid, and bubbles in the sub-tank H310 no longer get inside the individual liquid chamber H309. Therefore, it is possible to reliably remove as many bubbles as possible from the individual liquid chamber H309.

Each of the above-described embodiments is arranged in a way that the flow passage resistance from the ink flow passage H304 to the first air outlet port H51 is smaller than the flow passage resistance from the ink flow passage H304 to the second air outlet port H52. By virtue of this configuration, when bubbles are to be removed from the float valve mechanism, bubbles in the sub-tank H310 are first removed and the float valve of the sub-tank float valve mechanism H4A is sealed, thereafter bubbles in the individual liquid camber H309 are removed. As a result, bubble removal can be realized with a reduced amount of waste ink compared to the conventional configuration. Furthermore, because bubbles in the sub-tank H310 no longer get inside the individual liquid chamber H309 through the ink inlet filter H3071, more bubbles can be removed from the individual liquid chamber H309.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-302977, filed Nov. 22, 2007, which is hereby incorporated by reference herein in its entirety.

The invention claimed is:

1. A printhead comprising:

a first ink chamber having an inlet port, to which ink is supplied from an ink supply source;

a second ink chamber, to which ink is supplied from the first ink chamber;

a discharge orifice discharging ink from the second ink chamber;

a first discharge flow passage which discharges air from a discharge port arranged on top of the first ink chamber; and a second discharge flow passage which discharges air from the second ink chamber, wherein the air is discharged from the second ink chamber by the second discharge flow passage after the air is discharged from the first ink chamber by the first discharge flow passage.

2. The printhead according to claim 1, further comprising a filter arranged between the first and second ink chambers.

3. The printhead according to claim 1, further comprising a filter arranged between the second ink chamber and second discharge flow passage.

4. The printhead according to claim 1, further comprising a valve mechanism which blocks flow between the first ink chamber and the first discharge flow passage.

5. The printhead according to claim 4, wherein the valve mechanism comprises a float member having a lower specific gravity than that of the ink, and a seal member which blocks the flow between the first ink chamber and the first discharge flow passage by contacting the float member with the seal member.

6. The printhead according to claim 5, further comprising a detaching unit which detaches the float member from the seal member.

7. The printhead according to claim 1, further comprising a valve mechanism which blocks flow between the second ink chamber and the second discharge flow passage.

8. The printhead according to claim 7, wherein the valve mechanism comprises a float member having a lower specific gravity than that of the ink, and a seal member which blocks the flow between the second ink chamber and the second discharge flow passage by contacting the float member with the seal member.

9. The printhead according to claim 8, further comprising a detaching unit which detaches the float member from the seal member.

10. A printing apparatus comprising:

a first ink chamber having an inlet port, to which ink is supplied from an ink supply source;

a second ink chamber, to which ink is supplied from the first ink chamber;

a discharge orifice discharging ink from the second ink chamber;

a first discharge flow passage which discharges air from a discharge port arranged on top of the first ink chamber;

a second discharge flow passage which discharges air from the second ink chamber; and a decompression unit which decompresses the first discharge flow passage and the second discharge flow passage, wherein the air is discharged from the second ink chamber by the second discharge flow passage after the air is discharged from the first ink chamber by the first discharge flow passage.

* * * * *